US007950780B2

(12) United States Patent
Irinoda

(10) Patent No.: US 7,950,780 B2
(45) Date of Patent: May 31, 2011

(54) LIQUID JET HEAD AND IMAGE FORMING APPARATUS CONFIGURED TO OBTAIN AIR BUBBLE DISCHARGING PROPERTIES

(75) Inventor: Mitsugu Irinoda, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 854 days.

(21) Appl. No.: 11/894,847

(22) Filed: Aug. 22, 2007

(65) Prior Publication Data

US 2008/0055362 A1 Mar. 6, 2008

(30) Foreign Application Priority Data

Sep. 1, 2006 (JP) ..... 2006-237507

(51) Int. Cl.
*B41J 2/05* (2006.01)

(52) U.S. Cl. ..... 347/65; 347/45; 347/92

(58) Field of Classification Search ..... 347/20, 347/44, 45, 47, 54, 56, 61–65, 67–68, 70–71, 347/92–94

See application file for complete search history.

(56) References Cited

U.S. PATENT DOCUMENTS

| | | | | |
|---|---|---|---|---|
| 6,367,914 | B1 | 4/2002 | Ohtaka et al. | |
| 6,454,395 | B1 | 9/2002 | Irinoda | |
| 6,497,474 | B2 | 12/2002 | Irinoda et al. | |
| 7,338,148 | B2 * | 3/2008 | Ono | 347/45 |

FOREIGN PATENT DOCUMENTS

| | | | |
|---|---|---|---|
| JP | 61-141565 | | 6/1986 |
| JP | 63-122551 | | 5/1988 |
| JP | 5-155015 | | 6/1993 |
| JP | 11-58745 | | 3/1999 |
| JP | 1109118 A | * | 4/1999 |
| JP | 411091118 A | * | 5/1999 |
| JP | 11-198377 | | 7/1999 |
| JP | 3173187 | | 3/2001 |
| JP | 2001-105599 | | 4/2001 |
| JP | 2001-179996 | | 7/2001 |

* cited by examiner

*Primary Examiner* — Juanita D Stephens
(74) *Attorney, Agent, or Firm* — Cooper & Dunham LLP

(57) ABSTRACT

A liquid jet head includes a plurality of individual flow paths where nozzles configured to jet liquid are in communication; wherein a layer of an adhesive is formed on a side wall surface of the individual flow path; and the layer of the adhesive contains a material capable of having a photocalytic reaction obtaining hydrophilicity by light irradiation.

5 Claims, 8 Drawing Sheets

LIQUID JET HEAD AND IMAGE FORMING APPARATUS CONFIGURED TO OBTAIN AIR BUBBLE DISCHARGING PROPERTIES

BACKGROUND

1. Technical Field

This disclosure generally relates to liquid jet heads and image forming apparatuses.

2. Description of the Related Art

Generally, as an image forming apparatus such as a printer, facsimile, copier, plotter, or a multiple function processing machine including the printer, facsimile, copier, and the plotter, the following apparatus is known. In the apparatus, while a recording medium is conveyed, a liquid drop of recording liquid (hereinafter "ink") is adhered to the recording medium by using a liquid jet device including a recording head formed of a liquid jet head configured to jet the liquid drop of the recording liquid, so that image forming such as recording or printing is performed.

Hereinafter, the recording medium is called a sheet, a paper, a recording paper, or a transfer material. However, there is no limitation of material for the paper or the transfer material. The meanings of image forming include recording, printing, and others.

The image forming apparatus means an apparatus configured to jet liquid onto a medium such as a paper, thread, fiber, leather, hides, metal, plastic, glass, wood, or ceramic so that images are formed. "Image forming" means not only providing an image of characters, figures, or the like on the medium but also providing an image such as a pattern having no meanings on the medium. In addition, the liquid is not limited to the recording liquid or the ink and any liquid that is a fluid when being jetted can be applied to the liquid. Furthermore, the liquid jet device means a device configured to jet the liquid from the liquid jet head and is not limited to the device for image forming.

As a pressure generating part (actuator part) of the liquid jet head configured to generate pressure for pressurizing the ink that is a liquid in a individual flow path (hereinafter "pressurizing liquid room"), a piezo-electric actuator formed of a piezo-electric element or the like, a thermal actuator formed by a heat element or the like, an electrostatic actuator for generating an electrostatic force, and others are known.

In the meantime, in the liquid jet head, if an air bubble remains in a flow path when liquid flows, a liquid drop cannot be jetted from the nozzle (nozzle down) or bad jetting such that a jetting misdirection of the liquid drop may occur. Accordingly, it is desired to improve air bubble discharging properties. Because of this, a head is known where a hydrophilic or water-repellent surface treatment is applied to an inner wall surface of the flow path.

For example, Japanese Laid-Open Patent Application Publication No. 61-141565 describes that an inner wall surface of a nozzle is treated so as to be hydrophilic.

Japanese Laid-Open Patent Application Publication No. 2001-179996 describes that a water-repellent surface treatment is applied to a part coming in contact with an ink of an ink jet printer head main body.

Japanese Patent Publication No. 3173187 describes an ink jet head including ink flow path and nozzle holes arranged in contact with the flow paths for discharging ink in such a manner that the flow paths are formed partly or entirely of a piezo-electric material, wherein an insulation layer is formed on a surface coming in contact with the ink of the flow paths and the insulation layer of the flow paths is covered with a hydrophilic film made of alumina or zirconia.

Japanese Laid-Open Patent Application Publication No. 2001-195599 describes a head where a face surface that is an external surface of a member forming an orifice for jetting a liquid drop is coated with a material having ultra-hydrophilicity. Japanese Laid-Open Patent Application Publication No. 11-198377 describes a head where an inorganic hydrophilic film having a photocatalitic function is directly formed on inner walls of all ink flow paths from an inner wall of a common liquid chamber of a ceiling member to a jetting outlet.

Japanese Laid-Open Patent Application Publication No. 63-122551 describes a head where a first substrate forming a wall-shaped member limiting an ink flow path and a second substrate limiting an upper surface of the ink flow path and a discharge outlet by an adhesive layer whose wettability for ink is equal to or greater than that of the second substrate.

Japanese Laid-Open Patent Application Publication No. 11-58745 describes a head wherein a nozzle is formed by applying plasma dry etching from a pressurized room side to a resin molding nozzle forming member.

Japanese Laid-Open Patent Application Publication No. 5-155015 describes a head having a flow path plate having an ink cavity and a piezoelectric element filled with a filler of elastic material in a groove, many of which grooves divide a driving piezoelectric element which corresponds to the ink cavity, and are separated through a thin film member having a low coefficient of water absorption.

However, for example, in the head discussed in Japanese Patent Publication No. 3173187, the insulation layer is formed on the surface coming in contact with the ink of the flow paths and the insulation layer of the flow path is covered with a hydrophilic film made of alumina or zirconia. More specifically, the insulation film is formed by applying a thermal decomposition CVD method to an organic insulation layer.

Accordingly, a film thickness or a film thickness distribution is generated inside the flow path. In addition, a thermal treatment is applied by circulating liquid where alumina sol or zirconium sol is diluted as a hydrophilic film on such an organic insulation film surface so as to coat the film surface.

Therefore, due to the influence of the film thickness or a film thickness distribution of the base organic insulation film, the hydrophilic properties are varied so that even air bubble properties cannot be achieved.

On the other hand, as described in Japanese Laid-Open Patent Application Publication No. 61-141565, Japanese Laid-Open Patent Application Publication No. 2001-179996, Japanese Laid-Open Patent Application Publication No. 2001-195599, Japanese Laid-Open Patent Application Publication No. 11-198377, and Japanese Laid-Open Patent Application Publication No. 11-58745, since the hydrophilic treatment film or water-repellent treatment film is formed on the internal wall surface of the flow path, unevenness of the hydrophilicity or water-repellency may be generated due to influence of a material of a member forming the flow path. In addition, in the case where the water-repellent treatment is applied to the internal wall surface of the flow path, the ability to discharge air bubbles is bad.

In the meantime, in the image forming apparatus, it is required to output a higher quality image at a higher printing speed. Especially, for improvement of the printing speed, the head is made long. A full line type head which can cover the entire width of the medium is about to be realized.

In a long head such as a line type head, the size of a flow path member forming an individual liquid room becomes large. Accordingly, in a case where a complex flow path configuration is formed at low cost, it is preferable to apply a stacked structure such as double layer structure of a metal member such as SUS rather than an expensive member such as silicon.

In this case, while the flow path member is formed by connecting plural metal members by an adhesive. If wetting ability is a concern, an adhesive such as epoxy resin having low hydrophilicity is used. However, if the hydrophilicity of a part of the inner wall surface of the individual flow path is low, as discussed above, the air bubble discharge-ability becomes bad.

BRIEF SUMMARY

In an aspect of this disclosure, there are provided a liquid jet head whereby air bubble discharging properties are improved while selectable kinds of materials of a flow path member are increased, and an image forming apparatus having the liquid jet head.

In another aspect, there is provided a liquid jet head that includes: a plurality of individual flow paths where nozzles configured to jet liquid are in communication; wherein a layer of an adhesive is formed on a side wall surface of the individual flow path; and the layer of the adhesive contains a material capable of having a photocatalytic reaction obtaining hydrophilicity by light irradiation.

In another aspect, there is provided a liquid jet head that includes: a plurality of individual flow paths where nozzles configured to jet liquid are in communication; wherein a layer of an adhesive is formed on a side wall surface of the individual flow path; and a layer containing a material capable of having a photocatalytic reaction obtaining hydrophilicity by light irradiation is formed on the layer of the adhesive.

Other aspects, features, and advantages will become more apparent from the following detailed description when read in conjunction with the accompanying drawings.

DETAILED DESCRIPTION OF THE PREFERRED EMBODIMENTS

A description is given below, with reference to the FIG. 1 through FIG. 9 of embodiments of this disclosure.

First, a first embodiment of a liquid jet head is discussed with reference to FIG. 1 through FIG. 4.

Figure 1:
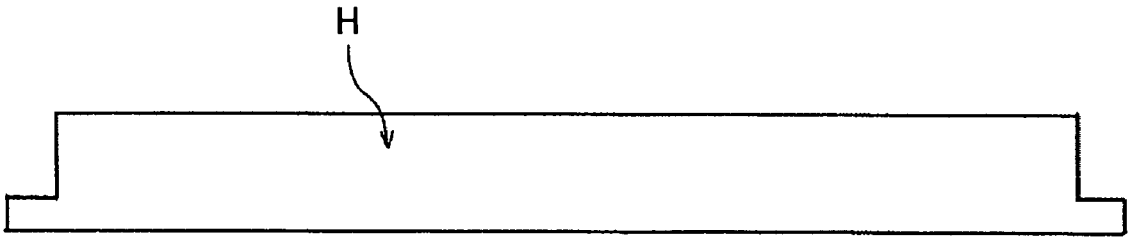
FIG. 1 is a side view of a liquid jet head of a first embodiment of this disclosure.
Figure 2:
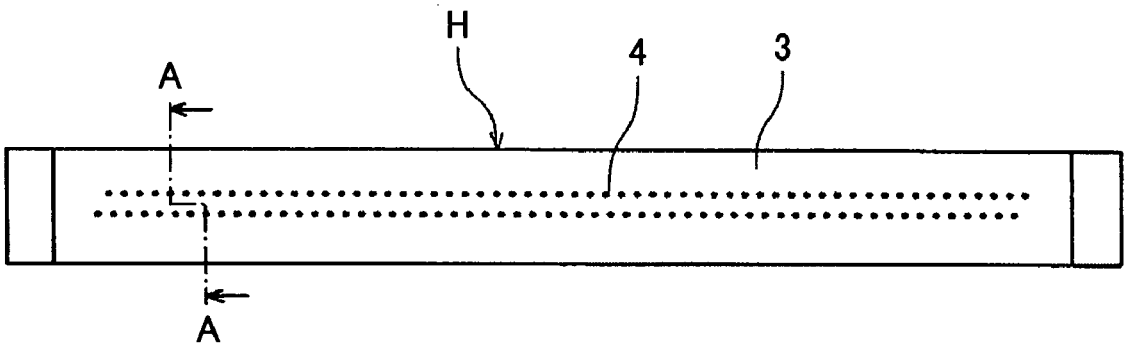
FIG. 2 is a plan view of the liquid jet head of the first embodiment of this disclosure.
Figure 3:
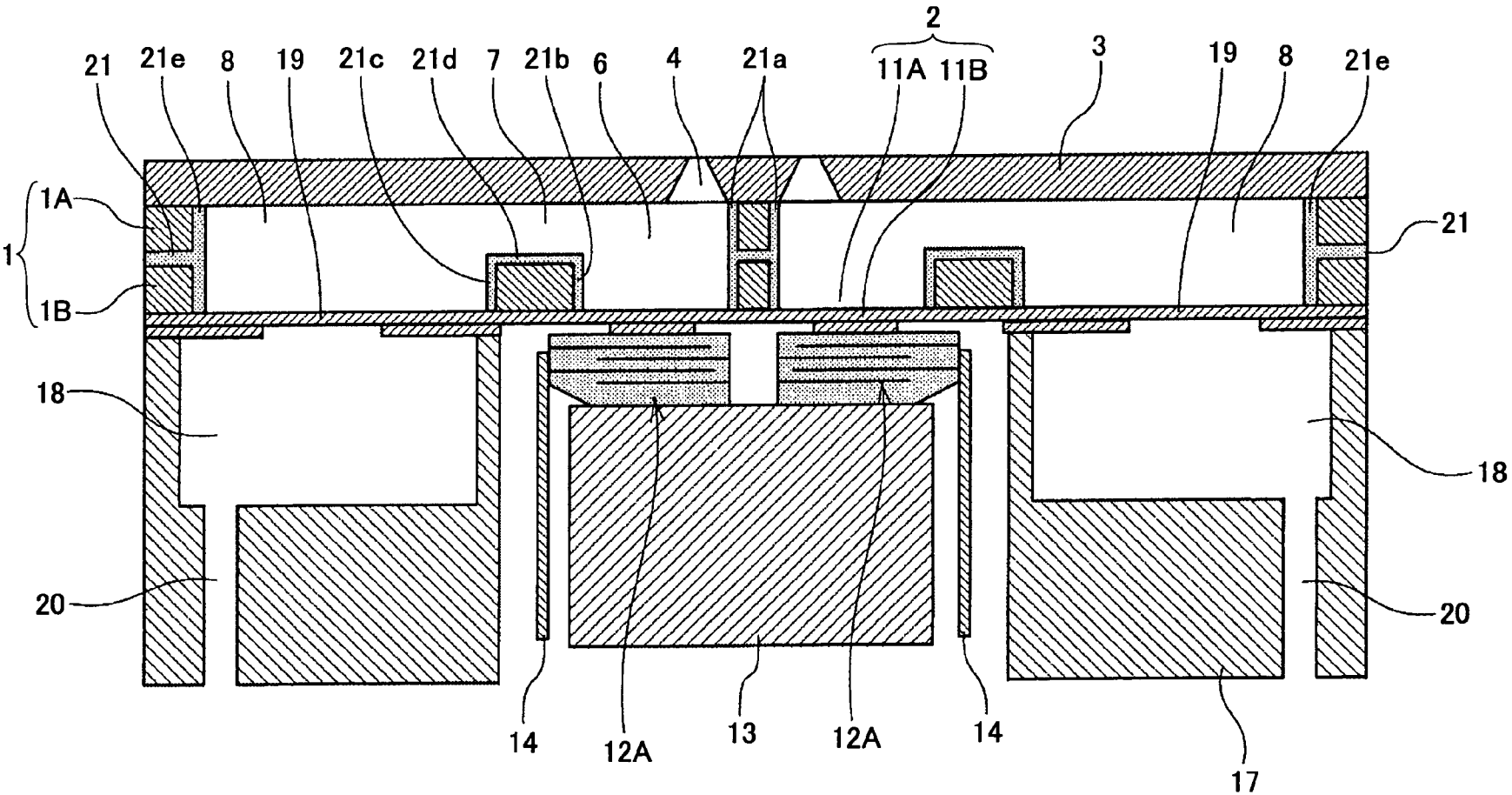
FIG. 3 is a first cross-sectional view taken along line A-A and in a direction perpendicular to an arrangement direction of liquid rooms of the liquid jet head of the first embodiment of this disclosure.
Figure 4:
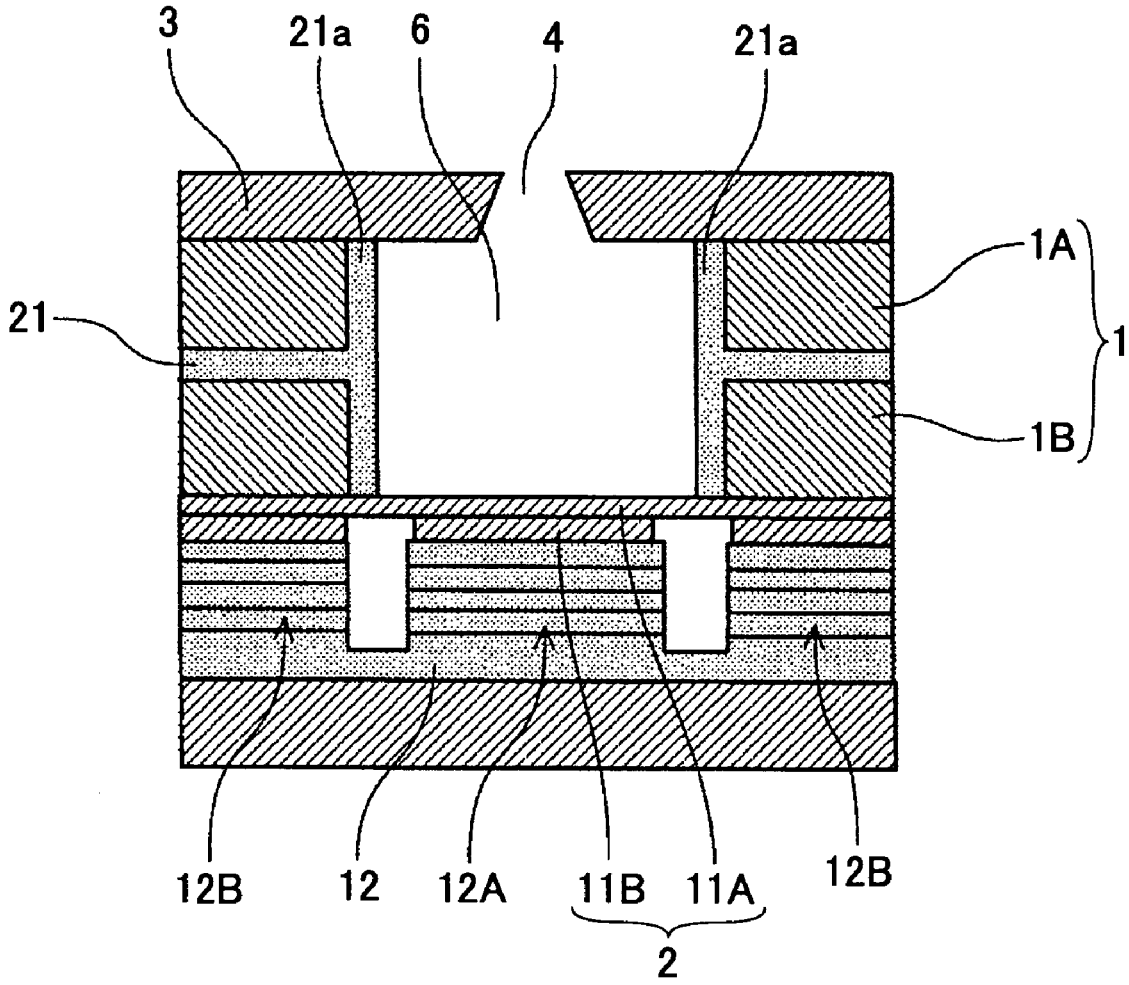
FIG. 4 is a second cross-sectional view in the direction perpendicular to the arrangement direction of the liquid rooms of the liquid jet head of the first embodiment of this disclosure.

Here, FIG. 1 is a side view of a liquid jet head of a first embodiment. FIG. 2 is a plan view of the liquid jet head of the first embodiment. FIG. 3 is a first cross-sectional view taken along line A-A and in a direction perpendicular to an arrangement direction of liquid rooms of the liquid jet head of the first embodiment. FIG. 4 is a second cross-sectional view in the direction perpendicular to the arrangement direction of the liquid rooms of the liquid jet head of the first embodiment.

As shown in FIG. 3, a liquid jet head H of the first embodiment includes a flow path board (liquid room board) 1, a vibration plate 2, and a nozzle plate 3. The flow path board 1 is formed of a SUS substrate. The vibration plate 2 is connected to a lower surface of the flow path board 1. The nozzle plate 3 is connected to an upper surface of the flow path plate 1.

Here, a manufacturing step of the liquid jet head using a manufacturing method of the liquid jet head is discussed.

A pressurizing liquid room 6, a fluid resistance part 7, and a common liquid room 8 are formed by the flow path board 1, the vibration plate 2, and the nozzle plate 3.

The pressurizing liquid room 6 is called a pressure room, pressurizing room, or flow path. A nozzle 4 configured to jet an ink drop is connected to the pressurizing liquid room 6 as an individual flow path. The fluid resistance part 7 works as a supplying path configured to supply ink (recording liquid) to the pressurizing liquid room 6. The common liquid room 8 supplies the recording liquid to plural pressurizing liquid rooms 6.

Recording liquid such as ink is supplied to the common liquid room 8 from a recording liquid tank (not shown in FIG. 3) via a supplying flow path.

Here, the flow path board 1 is formed by connecting plural restrictor plates 1A and chamber plates 1B to each other by an adhesive 21. An etching process using acid etching liquid or a mechanical process such as punching is applied to the SUS board to form openings in the flow path board 1 such as the pressurizing liquid rooms 6, the fluid resistance part 7, and the common liquid room 8.

The position of the restrictor plate 1A is opened and a position of the chamber plate 1B is not opened so that the fluid resistance part 7 is formed.

The vibration plate 2 is adhered and connected to the chamber plate 1B forming the flow path board 1 by the adhesive 21. The vibration plate 2 is formed by, for example, connecting a convex part 11B made of the SUS board to a resin member 11A made of polyimide. In addition, a member made of a metal plate such as nickel is used for the vibration plate 2.

As discussed above, by connecting the chamber plate 1B at a side of the vibration plate 2 of the fluid resistance part 7 to the vibration plate 2, it is possible to prevent a pressure reduction in the pressurizing liquid room 6 due to venting to the outside via the thin resin member 11A such as polyimide of the vibration plate 2. As a result of this, it is possible to efficiently jet the liquid drops.

The nozzle plate 3 has a large number of nozzles 4. Corresponding to each pressurizing liquid room 6, each nozzle 4 has a diameter of 10 through 30 μm. The nozzle plate 3 is adhered and connected to the restrictor plate 1A of the flow path board 1.

The nozzle plate 3 may be made of a metal such as stainless or nickel, resin such as a polyimide resin film, silicon and combinations thereof. In addition, in order to secure water repellency with an ink, a plating film or a water repellent film applied by a known method such as water repellent coating is formed on a nozzle surface, namely a surface (jet surface) in a jet direction.

A stacked type piezo-electric element 12A forming a pressure generation part (actuator part) corresponding to each pressurizing liquid room 6 is connected, via the convex part 11B, to an external surface of the vibration plate 2 (a surface of the vibration plate 2 opposite to the pressurizing room 6). In addition, pole parts 12B are connected so as to corresponding to barriers between the liquid rooms 6.

Plural piezo-electric elements 12A and pole parts 12B are formed in a single piezo-electric member 12 connected to a base member 13 so as not to be cut by a groove forming process (slit forming process).

The piezo-electric element 12 is fixed to a base member 13 along an arrangement direction of plural piezo-electric elements 12A and pole parts 12B. While the pole part 12B is also a piezo-electric element, a driving voltage is not applied to the pole part 12B so that the pole part 12B works as a simple pole part. In addition, a FPC cable 14 is connected to an end surface of the piezo-electric element 12A for providing a driving waveform.

An ink in the pressurizing liquid room 6 may be pressed by using displacement in a d33 direction as a piezo-electric direction of the piezo-electric element 12A. Alternatively, the ink in the pressurizing liquid room 6 may be pressed by using displacement in a d31 direction as a piezo-electric direction of the piezo-electric element 12A. In this embodiment, the ink in the pressurizing liquid room 6 is pressed by using displacement in the d33 direction as a piezo-electric direction of the piezo-electric element 12A.

It is preferable to form the base member 13 of a metal material. If the material of the base member 13 is a metal, it is possible to prevent heat accumulation due to self heating of the piezo-electric element 12A.

In addition, a frame member 17 is connected to a periphery of the vibration plate 2 by an adhesive. A buffer room 18 is formed in the frame member 17. The buffer room 18 neighbors the common liquid room 8 via a diaphragm part 19. The diaphragm part 19 is made of the resin member 11A of the vibration plate 2 and can be deformed.

The diaphragm part 19 forms a wall part between the buffer room 18 and the common liquid room 8. While the diaphragm part 19 is made of a member forming the vibration plate 2 in this embodiment, the material forming the diaphragm part 19 may not be common with the material forming the vibration plate 2 but may be different from the member forming the vibration plate 2.

A communicating path 20 is formed in the frame member 17 so as to provide communication between the buffer room 18 and the outside (atmosphere). In this case, an opening of the communicating path 20 is formed opposite to a surface where the nozzles 4 are formed, namely in a surface of the frame member 17, so as to provide communication with the atmosphere.

In other words, if the opening is made at the nozzle surface side, when the nozzle surface is wiped, the recording liquid may enter into the buffer room 18 via the communicating path 20 and therefore it is necessary to form an opening in a space covered with a so-called nozzle cover. On the other hand, it is possible to prevent the recording liquid from entering into the buffer room 18 by making the opening at the side opposite to the nozzle surface.

In addition, the communicating path 20 is formed in a position not facing the diaphragm part 19. Because of this, it is possible to prevent the diaphragm part 19 from being damaged due to insertion of foreign particles into the communicating path 20.

Furthermore, in this liquid jet head, the piezo-electric element 12A and the pole parts 12B are formed with a gap of 300 dpi (a pitch that results in 300 dpi printing resolution) and face each other so as to form two lines. In addition, two lines of the pressurizing liquid rooms 6 and the nozzles 4 with a gap of 150 dpi are arranged in a staggered manner so that a resolution of 300 dpi can be obtained by a single scanning. In this case, plural piezo-electric elements 12 arranged in a single line are the piezo-electric elements 12A that are mutually driven and the piezo-electric elements 12B that are simple pole parts and not driven.

In addition, in this liquid jet head as discussed above, most members are made of SUS and have its coefficient of thermal expansion. Accordingly, it is possible to avoid various problems due to thermal expansion when the head is formed or used.

In this liquid jet head, for example, a voltage applied to the piezo-electric element 12A is decreased from a standard electric potential so that the piezo-electric element 12A is contracted. When the vibration plate 2 forced downward and the volume of the pressurizing liquid room 6 is expanded, the ink flows into the pressurizing liquid room 6. After this, the voltage applied to the piezo-electric element 12A is increased so that the piezo-electric element 12A is extended in a stacked direction. The vibration plate 2 is deformed in the nozzle 4 direction so that the volume of the pressurizing liquid room 6 is reduced.

As a result of this, the recording liquid in the pressurizing liquid room 6 is pressed so that a drop of the recording liquid is jetted from the nozzle 4.

By returning the voltage applied to the piezo-electric element 12A to the standard voltage, the vibration plate 2 is restored to the initial position. As a result of this, the pressurizing liquid room 6 is expanded so that a negative pressure is generated. Therefore, at this time, the recording liquid flows from the common liquid room 8 into the pressurizing liquid room 6.

Because of this, after the vibration of a meniscus surface of the nozzle 4 attenuates and becomes stable, an operation for the next liquid drop jetting is done.

In this liquid jet head, in a case where the pressure change is propagated from the pressurizing liquid room 6 into the common liquid room 8 due to the liquid drop jetting, the diaphragm part 19 of the buffer room 18 is deformed so that pressure change is absorbed.

In this case, even if a large number of the nozzles 4 are simultaneously driven so that the liquid drops are jetted and a large pressure change is propagated to the common liquid room 8, since the buffer room 18 is in communication with the outside via the communicating path 20, the diaphragm part 19 can be sufficiently deformed so that a large pressure change can be efficiently absorbed.

A method for driving the head is not limited to the above-mentioned example (pull-push out); pulling out or pushing out may be implemented depending on providing the driving wave.

Next, a structure of the flow path board 1 of the liquid jet head is discussed with details. As discussed above, the flow path board 1 is formed by connecting the restrictor plates 1A and the chamber plates 1B to each other by the adhesive 21.

An adhesive containing a material capable of having a photocalytic reaction obtaining hydrophilicity by light irradiation such as titanium oxide is used as the adhesive 21. Adhesive layers 21*a* through 21*e* are formed on internal wall surfaces of the restrictor plates 1A and the chamber plates 1B, namely a side wall surface of the pressurizing liquid room 6, a side wall surface and a surface in a direction along flow of the liquid of the fluid resistance part 7, and a side wall surface of the common liquid room 8. The photocalytic reaction is developed on the surfaces of the adhesive layers 21*a* through 21*e* so that the hydrophilicity is achieved.

Here, a manufacturing step of the liquid jet head using a manufacturing method of the liquid jet head of the present invention is discussed.

After the adhesive 21 containing the material capable of having the photocalytic reaction such as titanium oxide is applied to the restrictor plates 1A and the chamber plates 1B by using a spray method, the restrictor plates 1A and the chamber plates 1B are connected to each other.

By using the spray method for applying the adhesive 21, the adhesive layers 21*a* through 21*e* containing the material capable of having the photocalytic reaction are formed on the internal wall surface of the restrictor plates 1A. Furthermore, by using the spray method for applying the adhesive 21, morphology is formed on the surfaces of the adhesive layers 21*a* through 21*a* at the time when the drops reach the layers so that smooth convexities and concavities are formed.

Because of this, after the adhesive 21 is applied, a UV light is irradiated on the surfaces of the adhesive layers 21*a* through 21*e* containing titanium oxide that is the material capable of having the photocalytic reaction so that the photocalytic reaction tales place. As a result of this, the surfaces of the adhesive layers 21*a* through 21*e* are changed so as to have hydrophilicity.

Alternatively, after applying the adhesive 21, an $O_2$ plasma process is applied to the surfaces of the adhesive layers 21*a* through 21*e* so that convexities and concavities are formed on the surfaces by the plasma process and a UV light that has a luminous wavelength of $O_2$ plasma is simultaneously irradiated. As a result of this, the surfaces of the adhesive layers 21*a* through 21*e* are changed so as to have hydrophilicity.

Thus, the surfaces of the adhesive layers 21*a* through 21*e* that form a side wall surface of the pressurizing liquid room 6 have hydrophilicity that means a state where the static contact angle of the jet liquid is equal to or less than 20 degrees. Therefore, the air bubbles may not be adhered when the liquid fills the liquid jet head so that the air bubble discharge ability is improved.

In addition, for deposition, the material capable of having the photocalytic reaction is applied to the flow path board 1 (the restrictor plates 1A and the chamber plates 1B) not directly but via the adhesive 21. Therefore, the photocalytic reaction is not influenced by the material forming the flow path board 1 so that the photocalytic reaction can be stable.

As a result of this, as a member forming the flow path board 1, it is possible to use a relatively economical member such as SUS. In addition, by connecting the plural members to each other, it is possible to secure a desirable flow path configuration. Hence, it is possible to have a wide selection of materials for the flow path member.

Furthermore, since wetability of the adhesive 21 is improved by the photocalytic reaction, it is possible to select water-repellent resin having a good wetting ability as a base of the adhesive. Therefore, reliability of connection and durability of the head are improved.

In addition, in this embodiment, since a step for newly coating the material having the photocalytic reaction on the surfaces of the adhesive layers is not required, it is possible to reduce the cost.

In order to secure a long term effect of the hydrophilicity and cleaning action that are effects of the photocalytic reaction, silica ($SiO_2$) particles may be contained in the adhesive. In this case, the silica may function as a gap agent for forming a gap for stably connecting plural members to each other.

Since the surfaces of the adhesive layers 21*a* through 21*e* forming the side wall surface of the pressurizing liquid room 6 have a convex and concave configuration, the air bubbles may not be adhered so that the air bubble discharge ability can be improved. In this case, as discussed above, even if the smooth convex and concave configuration due to the morphology is used as it is, the air bubble discharge ability can be improved. Alternatively, by applying a surface roughening process using the $O_2$ plasma process, the air bubble discharge ability can be improved.

Next, a liquid jet head of a second embodiment is discussed with reference to FIG. 5 and FIG. 6.

Figure 5:
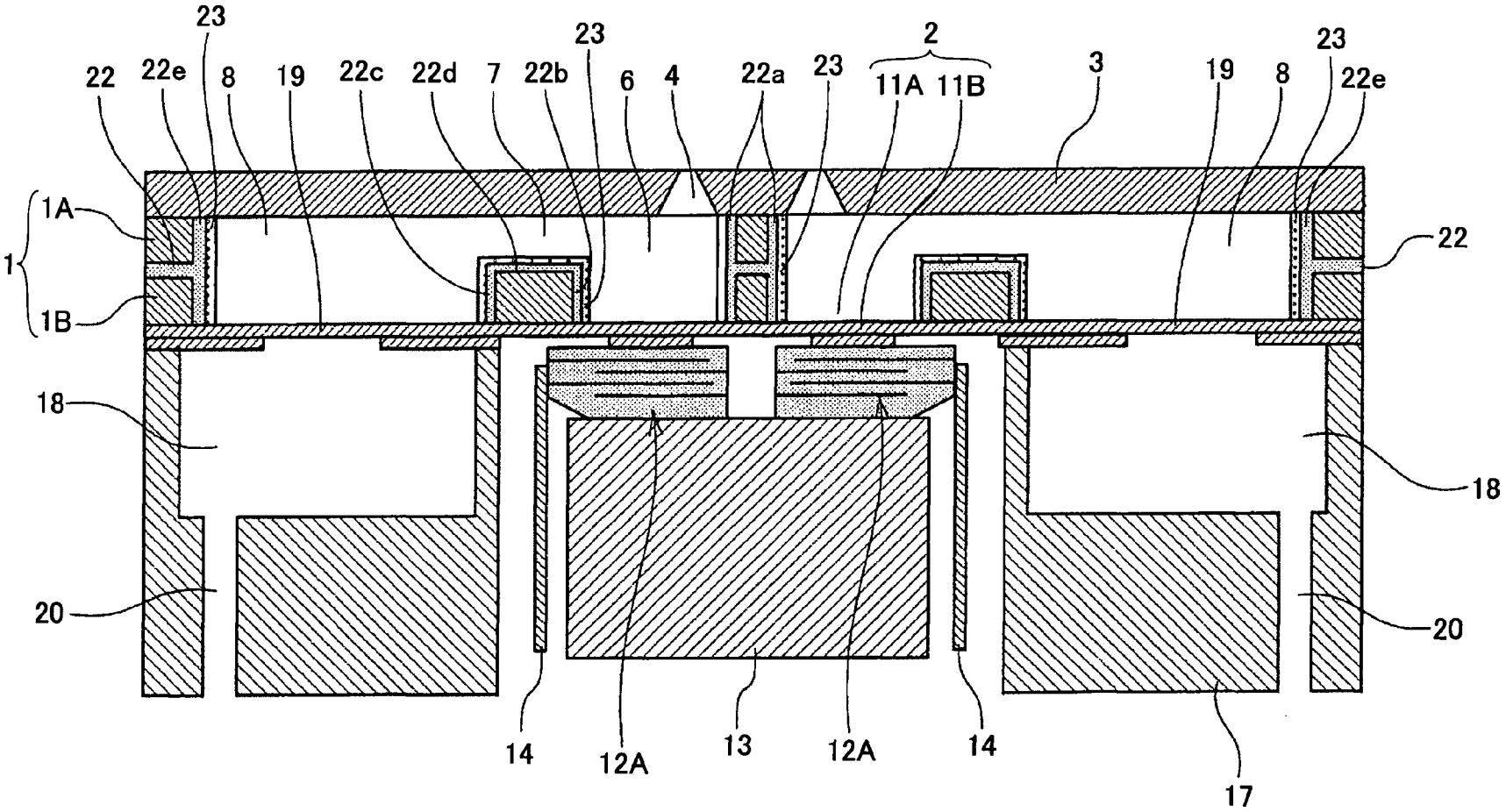
FIG. 5 is a first cross-sectional view in a direction perpendicular to an arrangement direction of liquid rooms of a liquid jet head of a second embodiment of this disclosure.
Figure 6:
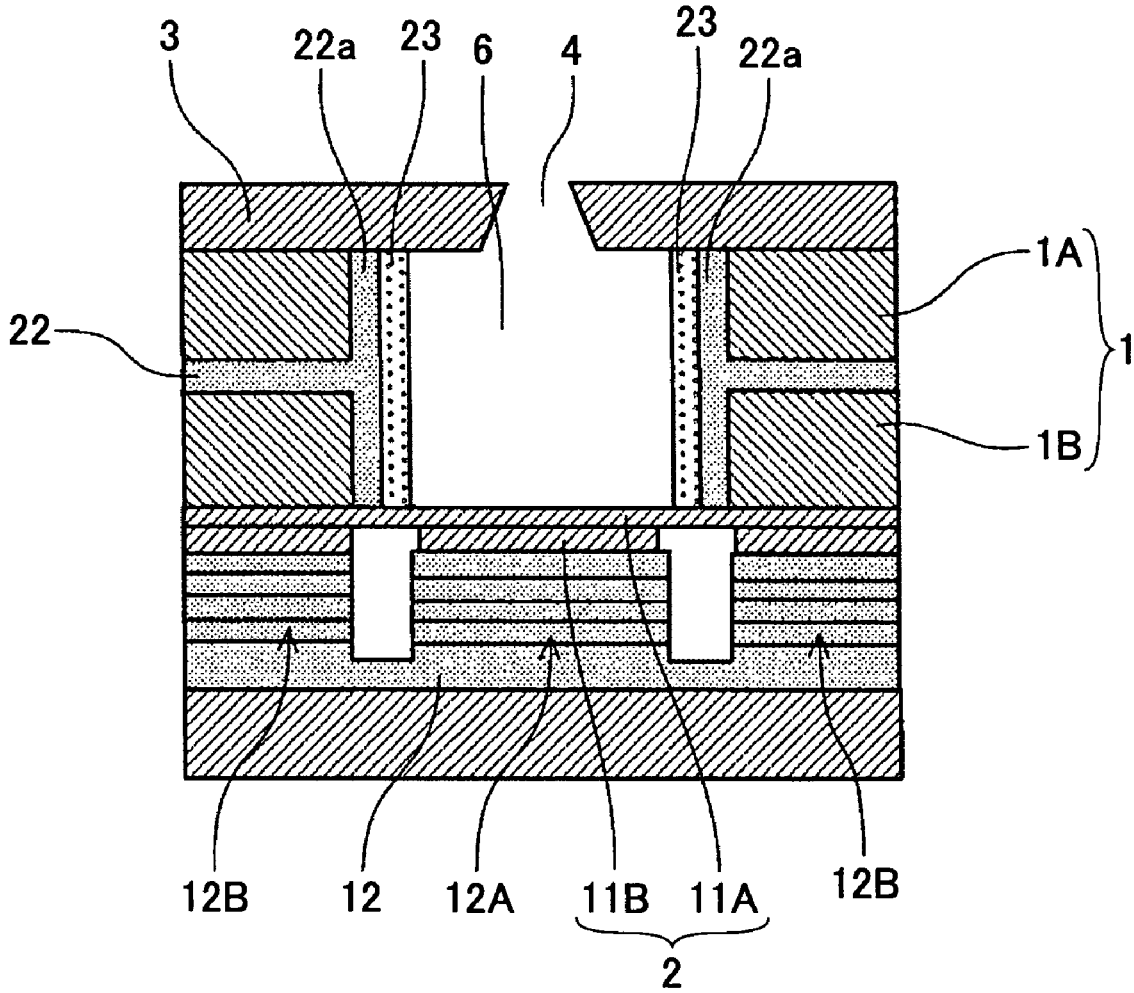
FIG. 6 is a second cross-sectional view in the direction perpendicular to the arrangement direction of the liquid rooms of the liquid jet head of the second embodiment of this disclosure.

Here, FIG. 5 is a first cross-sectional view in a direction perpendicular to an arrangement direction of liquid rooms of a liquid jet head of a second embodiment. FIG. 6 is a second cross-sectional view in the direction perpendicular to the arrangement direction of the liquid rooms of the liquid jet head of the second embodiment.

In this liquid jet head unlike that of the first embodiment, a normal epoxy resin adhesive not containing a material capable of having the photocatalytic reaction is used as the adhesive 22 for connecting the restrictor plates 1A and the chamber plates 1B that are plural members forming the flow path member to each other. The normal epoxy resin adhesive is applied to the restrictor plates 1A and the chamber plates 1B by the spray method so that the restrictor plates 1A and the chamber plates 1B are connected to each other.

Thus, by applying the adhesive 22 by the spray method, adhesive layers 22*a* through 22*e* are formed on an internal wall surface of the restrictor plates 1A, namely a side wall surface of the pressurizing liquid room 6, a side wall surface and a surface in a direction along flow of the liquid of the fluid resistance part 7, and a side wall surface of the common liquid room 8.

In this case, by applying the adhesive 22 by the spray method, morphology is formed on the surfaces of the adhesive layers 22*a* through 22*a* at the time when the drops reach the layers so that a smooth convex and concave configuration is formed.

In addition, on the surfaces of the adhesive layers 22*a* through 22*e*, a photocalytic layer made of a material capable of having a photocalytic reaction obtaining hydrophilicity by light irradiation is formed. More specifically, titanium oxide is used as the material having photocalytic reaction capability.

After the surfaces of the adhesive layers 22*a* through 22*e* are diluted by alcohol, by a method such as spray coating, spin coating, or dipping, an organic titanium compound is applied to the surfaces of the adhesive layers 22*a* through 22*e*, heated and dried. As a result of this, the photocalytic layer 23 is formed and UV light is irradiated. Alternatively, water solution of an inorganic titanium compound is applied by the above-mentioned method, heated, and dried so that the photocalytic layer 23 is formed.

In this case, the photocalytic layer 23 is formed on the surface of the adhesive layer and is not formed on the side wall surface of the flow path member 1. Hence, the photocalytic layer 23 having photocalytic reaction can be formed on the side wall surface without influence of the material forming the flow path member 1.

In other words, in the second embodiment as well as the first embodiment, as a member forming the flow path board 1, it is possible to use a relatively economical member such as SUS. In addition, by connecting the plural members to each other, it is possible to secure a desirable flow path configuration. Hence, it is possible to have a wide selection of materials for the flow path member.

In addition, when the layer 23 having the photocalytic reaction covers the adhesive layers 22*a* through 22*e*, the liquid may not directly come in contact with the adhesive. The adhesive can be selected without considering the wetting ability and therefore it is possible to have a side selection of materials for the flow path member.

Furthermore, since the photocalytic layer 23 forming the side wall surface of the pressurizing room 6 has water repellency, the air bubbles may not be adhered so that the air bubble discharge ability can be improved. In addition, by the cleaning action of the surface due to oxidization of the photocalytic layer 23, it is possible to prevent degradation of the hydrophilicity due to adhesion of solid elements distributed during liquid filling to the side wall surface. Therefore, it is possible to obtain stable air bubble discharge ability for a long period of time.

Since a convex and concave configuration is formed on the surfaces of the adhesive layers 22*a* through 22*e* forming the side wall surface of the pressurizing liquid room 6, the air bubble discharge ability can be improved. In this case, as discussed above, even if the smooth convex and concave configuration due to the morphology is used as it is, the air bubble discharge ability can be improved. Alternatively, by applying a surface roughening process using the $O_2$ plasma process, the air bubble discharge ability can be improved.

In addition, in this embodiment, since a step for newly coating the material capable of having the photocalytic reaction on the surfaces of the adhesive layers is not required, it is possible to reduce the cost.

In order to secure a long term effect of the hydrophilicity and cleaning action that are effects of the photocalytic reaction, silica ($SiO_2$) particles may be contained in the adhesive. In this case, the silica may function as a gap agent for forming a gap for stably connecting plural members to each other.

In addition, by implementing the UV light irradiation, it is possible to achieve hydrophilicity more efficiently than by natural light.

Next, an image forming apparatus of an example of this disclosure having a liquid jet head including a liquid jet device is discussed with reference to FIG. 7.

Figure 7:
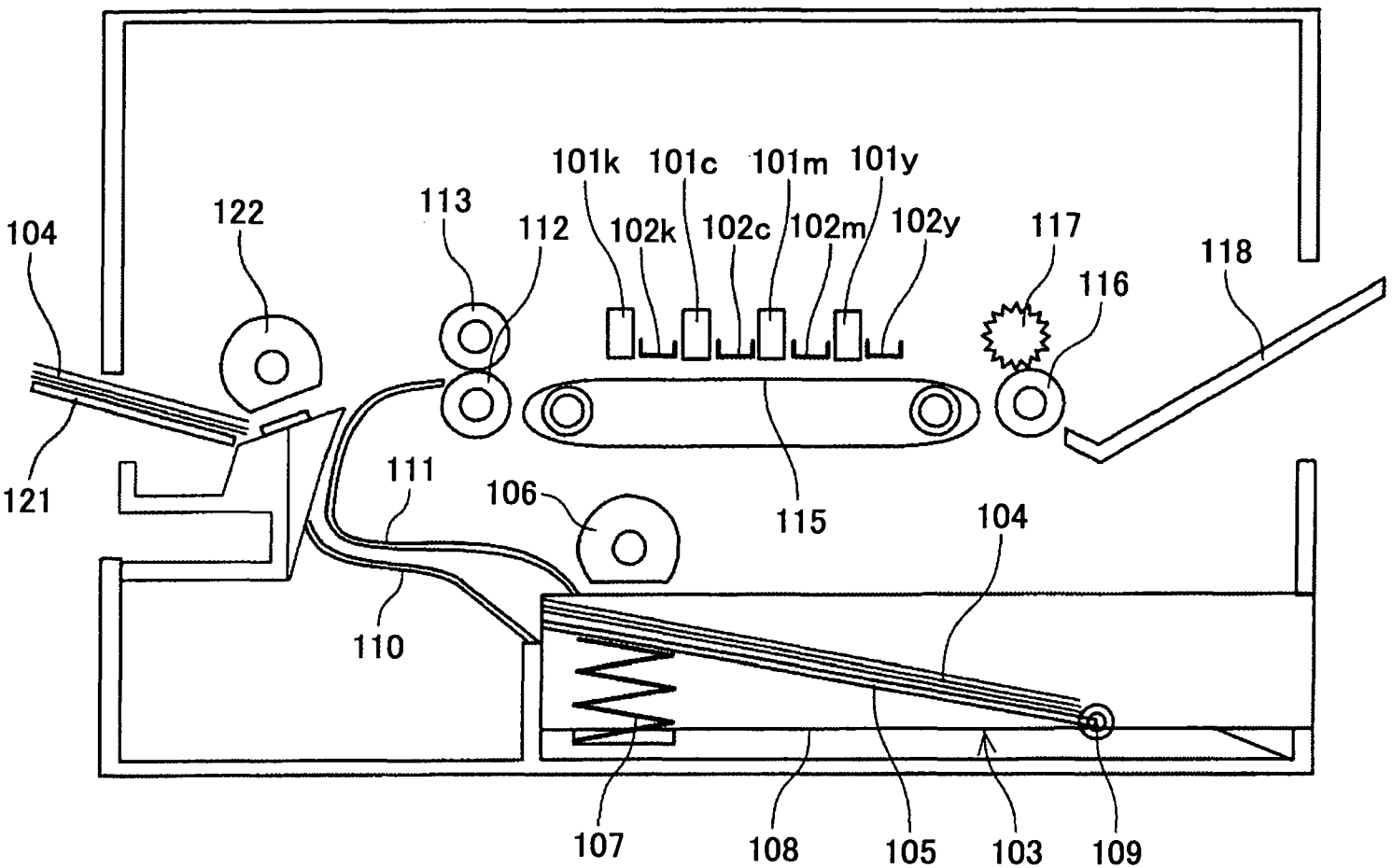
FIG. 7 is a schematic structural view of an image forming apparatus of an example of this disclosure having a liquid jet head including the liquid jet device of the embodiment of this disclosure.

Here, FIG. 7 is a schematic structural view of the image forming apparatus of the example having the liquid jet head including the liquid jet device of the embodiment of this disclosure.

The image forming apparatus of this embodiment is a line type image forming apparatus where a recording head that is a full line type head having a nozzle line (formed by arranging the nozzles 4) having a length equal to or greater than a printing area width of the paper is provided.

This image forming apparatus has recording heads 101*k*, 101*c*, 101*m*, and 101*y* (recording heads 101) formed by four full line type liquid jet heads configured to jet liquid droplets of black (K), cyan (C), magenta (M), and yellow (Y). Each of the recording heads 101 are provided at the head holder (not shown) so that a surface forming the nozzle 4 faces downward.

In addition, corresponding to each of the recording heads 101, the maintaining and recovering mechanism 102 for maintaining and recovering properties of the head is provided. At the time of maintaining and recovering operations of the properties of the head such as a purging process or a wiping process, the recording heads 101 and the maintaining and recovering mechanism 102 are relatively moved so that the capping member and others forming the maintaining and recovering mechanism 102 are made to face the nozzle surface of the recording head 101.

While the recording heads 101 are arranged so as to jet liquid drops of each of colors of black (K), cyan (C), magenta (M), and yellow (Y) in this order from an upper stream side in the paper conveyance direction in this example, the arrangement and the numbers of colors are not limited to this.

In addition, as the line type head, single or plural heads where plural nozzle lines for jetting each of the liquid drops are arranged with a designated gap may be used. The head and the recording liquid cartridge for supplying the recording liquid to the head may be united or provided separately.

A paper feeding tray 103 has a bottom plate where the paper 104 is provided and a crescent-shaped roller (paper feeding roller) 106 for feeding the papers 104. The bottom plate 105 can be rotated with respect to a rotational shaft 109 provided to a base 108 and is biased toward the paper feeding roller 106 by a pressing spring 110.

A separation pad (not shown) made of a material with a high coefficient of friction such as synthetic leather or cork is provided so as to face the paper feeding roller 106 in order to prevent sending overlapped papers 104. In addition, a release cam (not shown) is provided so as to release contact of the bottom plate 105 and the paper feeding roller 106.

Guide members 110 and 111 for guiding the paper 104 are provided so that the paper 104 fed from the paper feeding tray 103 is forwarded between the conveyance roller 112 and a pinch roller 113.

The conveyance roller 112 is rotated by a driving source (not shown) so that the paper 104 is conveyed toward a platen 115 facing the recording head 101. As long as a gap between the recording head 101 and the paper 104 can be maintained, the platen may be a rigid structural body and the conveyance belt may be used.

At a downstream side of the platen 115, a paper discharge roller 116 for discharging the paper 104 where an image is formed and a roller 117 facing the paper discharge roller 116 are provided. The paper 104 where the image is formed is discharged to the paper discharge tray 118 by the paper discharge tray 116.

At a side opposite to the paper discharge tray 118, a manual tray 121 and a paper feeding roller 122 are provided. The manual tray 121 is used for manually feeding the paper 104. The paper feeding roller 122 feeds the paper 104 mounted in the manual tray 121. The paper 104 fed from the manual tray 121 is guided by the guide member 111 and sent between the conveyance roller 112 and the pinch roller 113.

In this image forming apparatus, at a waiting state, the release cam pushes the bottom plate 105 to a designated position of the paper feeding tray 103 so that the contact of the bottom plate 105 and the paper feeding roller 106 are released. In this state, the conveyance roller 112 is rotated and this rotating driving force is transmitted to the paper feeding roller 106 and the release cam (not shown) by a gear (not shown) so that the release cam is separated from the bottom plate 105 and the bottom plate 105 rises. As a result of this, the paper feeding roller 106 and the paper 104 come in contact with each other and the paper 104 is picked up as the paper feeding roller 106 is rotated so that paper feeding is started. The papers 104 are separated by a separating claw (not shown) one by one.

By the rotation of the paper feeding roller 106, the paper 104 is guided by the guide members 110 and 11 so as to be sent between the conveyance roller 112 and the pinch roller 113. The paper 104 is sent onto the platen 113 by the conveyance roller 112.

After that, the rear end of the paper 104 faces a D-cut part and the contact is released, so that the paper 104 is conveyed onto the platen 115. A conveyance rotating pair may be provided between the paper feeding roller 116 and the conveyance roller 112 as a supplement.

Thus, the liquid drops are jetted from the recording head 1 so that the image is formed on the paper 104 conveyed on the platen 115. The paper 104 where the image is formed is discharged by the paper discharge roller 116 to the paper discharge tray 118. The speed for conveying the paper at the time of image forming and the timing of the liquid drop jetting are controlled by a control part (not shown).

As discussed above, by providing the line type liquid jet head of this disclosure having a high air bubble discharge ability, it is possible to obtain stable liquid jetting properties so that a high quality image can be formed at high speed.

Next, an image forming apparatus of another example of this disclosure having the liquid jet device of the embodiment of this disclosure is discussed with reference to FIG. 8 and FIG. 9.

Figure 8:
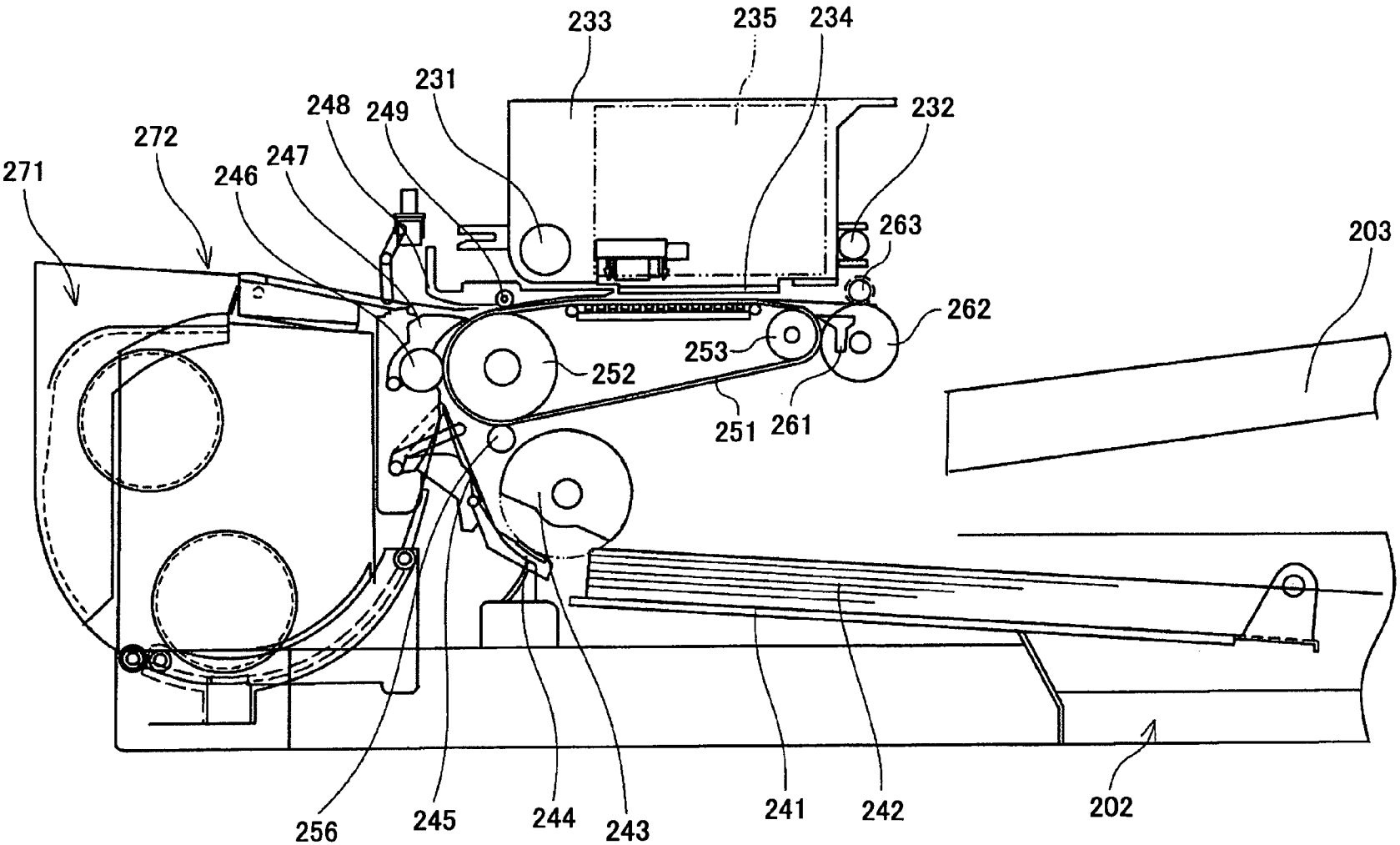
FIG. 8 is a schematic structural view of an image forming apparatus of another example of this disclosure having the liquid jet device of the embodiment of this disclosure.

Here, FIG. 8 is a schematic structural view of the image forming apparatus of another example having the liquid jet device of the embodiment of this disclosure. FIG. 9 is a partial plan view of the image forming apparatus of another example having the liquid jet device of the embodiment of this disclosure.

Figure 9:
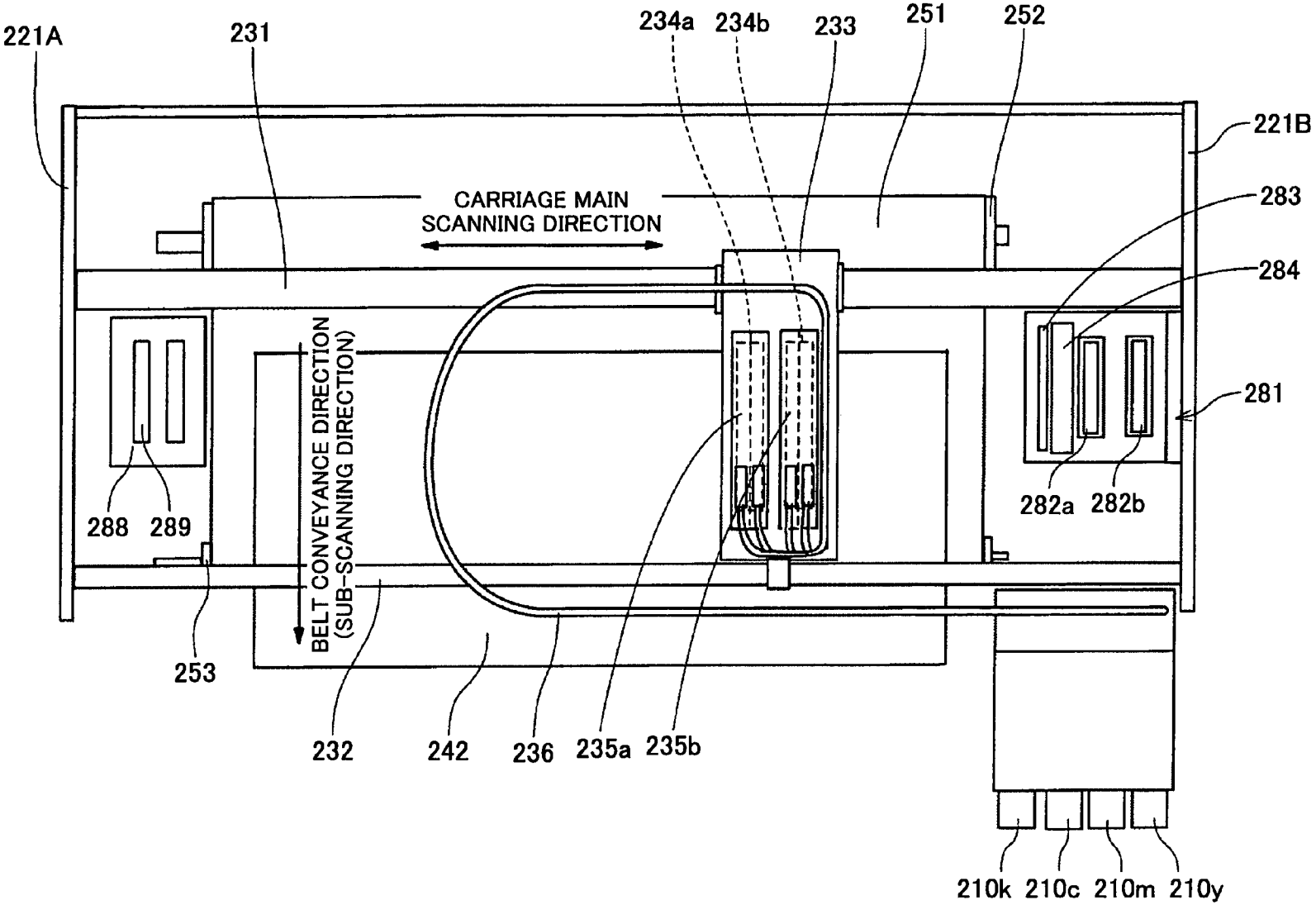
FIG. 9 is a partial plan view of the image forming apparatus of another example of this disclosure having the liquid jet device of the embodiment of this disclosure.

The image forming apparatus shown in FIG. 8 and FIG. 9 is a serial type image forming apparatus. In this image forming apparatus, a carriage 233 is held by a guide rail 231 and a guide rail 232 which are guide members provided between side plates 221A and 221B left and right so as to be able to slide in a main scanning direction. The carriage moves and scans in the main scanning direction indicated by an arrow in FIG. 9 via a timing belt driven by a main scanning motor (not shown).

The carriage 233 includes recording heads 234*a*, 234*b* (recording head 234) composed of four individual liquid jet heads 107*k*, 107*c*, 107*m*, and 107*y* of black (K), cyan, (C), magenta (M), and yellow (Y), respectively, for ejecting ink droplets of respective colors. The recording heads 234 are provided in a sub-scanning direction perpendicular to a main scanning direction that is a direction where plural nozzles are arranged and ink is ejected from the ink ejection openings in the downward direction.

Each of the recording heads 234 has two nozzle lines. One of the nozzle lines of the recording head 234*a* jets liquid drops of black (K) and another of the nozzle lines of the recording head 234*a* jets liquid drops of cyan (C). One of the nozzle lines of the recording head 234*b* jets a liquid drop of magenta (M) and another of the nozzle lines of the recording head 234*b* jets liquid drops of yellow (Y).

The carriage 233 includes sub tanks 235*a*, 235*b* (sub tanks 235) of the four colors for supplying the respective color inks to the recording heads 234. The color inks are supplied from ink cartridges 210*k*, 210*c*, 210*m*, and 210*y* through ink supply tubes 36 to the corresponding sub tanks 235.

In addition, the image forming apparatus includes a paper feeding part configured to feed papers 242 stacked on a paper stacking part (pressure plate) 241 of a paper feeding tray 202. The paper feeding part includes a crescent-shaped roller (paper feeding roller) 243 that separates and feeds the papers 242 one by one from the paper stacking part 241 and a separation pad 244 formed of a material with a high coefficient of friction and provided to oppose the paper feeding roller 243. The separation pad 244 is biased toward the paper feeding roller 243.

In order to forward the paper 242 fed from the paper feeding part to a lower side of the recording head 234, the image forming apparatus also includes a guide member 245 configured to guide the paper 242, a counter roller 246, a conveyance guide member 247, and a pressing member 248 including a head end pressing roller 249.

The image forming apparatus also includes a conveyance belt 251 as a conveying part configured to statically attract the paper 242 and convey the paper 242 in a position facing the recording head 234.

The conveyance belt 251 is an endless belt and is tensioned between the conveying roller 252 and the tension roller 253. The image forming apparatus also includes an electrostatic charging roller 256 as an electrostatic charging part configured to charge a surface of the conveyance belt 251.

The electrostatic charging roller 256 comes in contact with a surface layer of the conveyance belt 251 and is rotated following the rotation of the conveyance belt 251. A sub-scanning motor not shown rotates the conveying roller 252 via the timing belt so that the conveyance belt 251 is rotated in a belt conveyance direction indicated in FIG. 9.

In addition, as a paper discharge part configured to discharge the paper 242 recorded by the recording head 234, there are a separation claw 261, paper discharge rollers 262 and 263, and a paper discharge tray 203. The separation claw 261 separates the paper 242 from the conveyance belt 251. The discharged papers 242 are stacked in the paper discharge tray 203.

A both-sides paper feeding unit 271 is detachably provided at a rear side. The both-sides paper feeding unit 271 takes in the paper 242 returned by a reverse rotation of the conveyance belt 251 and reverses the paper 242 so as to feed the paper 242 again between the counter roller 246 and the conveyance belt 251. The upper surface of the both-sides paper feeding unit 271 works as a manual tray 272.

A maintaining and recovering mechanism 281 for maintaining and recovering the operability of the nozzles of the recording head 234 is provided in a non-printing area at one side in the scanning direction of the carriage 233.

The maintaining and recovering mechanism 281 includes caps 282*a*, 282*b* (caps 282), a wiper blade 283, a test jet receiving part 284, and others.

The caps 157 cap the corresponding nozzle surfaces of the recording head 234. The wiper blade 283 is a blade member for wiping the nozzle surfaces. The test jet receiving part 284 receives liquid drops at the time of test jetting for jetting a thickening liquid not contributing to recording.

An ink receiving unit (receiver of test jetting) 288 is provided in another non-printing area at one side in the scanning direction of the carriage 233. The ink receiving unit 288 is a liquid receiving vessel configured to receive a liquid drop at the time of test jetting for jetting a thickening liquid not contributing to recording. This ink receiving unit 288 includes an opening part 289 along the nozzle line direction of the recording head 234.

In the image forming apparatus having the above-discussed structure, the papers 242 are separated and fed from the paper discharge part one by one. The paper 242 fed to the upper part in a substantially vertical direction is guided by the guide 245 and clamped and conveyed by the conveyance belt 251 and the counter roller 246. In addition, the head end of the paper 242 is guided by the conveyance guide member 247. The paper 242 is pressed to the conveyance belt 251 by the head end pressing roller 249 and the conveyance direction of the paper 242 is changed by substantially 90 degrees.

At this time, a positive output and a negative output are alternately and repeatedly applied to the charging roller 256. In other words, an alternating voltage is applied so that positive and negative electrical charges are applied to the conveyance belt 251 in a rotation direction, namely a sub-scanning direction, forming belts at a designated width.

When the paper 242 is fed onto the conveyance belt 251 that has alternately charged positive and negative belts, the paper 242 is adhered to the conveyance belt 251 by the electrostatic force. The paper 242 is conveyed in the sub-scanning direction by rotational moving of the conveyance belt 251.

Ink drops of a single line are jetted onto the stopped paper 242 for recording by driving the recording head 234 corresponding to the image signal while the carriage 233 is moved in the main scanning direction. After the paper 242 is conveyed at a designated length, recording for the next line is performed.

A recording finishing signal or a signal indicating that the rear end of the paper 242 has reached a recording area is received, so that the recording operation is finished and the paper 242 is discharged to the paper discharge tray 203.

Thus, even in the above-discussed serial type image forming apparatus, by providing the liquid jet head having a high air bubble discharge ability, it is possible to obtain stable liquid drop properties so that a high quality image can be recorded at high speed.

According to the above-discussed embodiment of this disclosure, it is possible to provide a liquid jet head, including a plurality of individual flow paths where nozzles configured to jet liquid are in communication; wherein a layer of an adhesive is formed on a side wall surface of the individual flow path; and the layer of the adhesive contains a material capable of having a photocatalytic reaction obtaining hydrophilicity by light irradiation.

According to the above-mentioned liquid jet head, it is possible to select a material for the flow path member forming the individual flow path without considering the wetting ability so that it is possible to have a wide selection of materials for the flow path member. In addition, since the flow path member contains a material capable of having photocalytic reaction, it is possible to improve the air bubble discharge ability.

In addition, since the wettability of the adhesive is improved by the photocalytic reaction, it is possible to select a water-repellent resin material having a good wetting ability as a base of the adhesive so that connecting reliability and durability of the head can be improved.

A flow path member forming the individual flow path may be made by connecting plural members to each other by the adhesive.

A smooth convex and concave configuration may be formed on the surface having the photocalytic reaction, the surface being the side wall surface of the individual flow path.

The surface having the photocalytic reaction, the surface being the side wall surface of the individual flow path, may be made rough.

According to the above-discussed embodiment, it is possible to provide a liquid jet head, including: a plurality of individual flow paths where nozzles configured to jet liquid are in communication; wherein a layer of an adhesive is formed on a side wall surface of the individual flow path; and a layer containing a material capable of having a photocatalytic reaction obtaining hydrophilicity by light irradiation is formed on the layer of the adhesive.

According to the above-mentioned liquid jet head, it is possible to select a material for the flow path member forming the individual flow path without considering the wetting ability so that it is possible to have a wide selection of materials for the flow path member. In addition, since a layer containing a material having photocalytic reaction is formed, it is possible to improve the air bubble discharge ability.

In addition, since the adhesive is covered with the layer having the photocalytic reaction, the liquid does not come in contact with the adhesive directly. Hence, without considering wetting ability, it is possible to select the adhesive and thus it is possible to have a wide selection of materials for the flow path member.

According to the above-discussed embodiment, it is possible to provide a liquid jet head device configured to jet a liquid drop from a liquid jet head, the liquid jet head device including a plurality of individual flow paths where nozzles configured to jet liquid are in communication; wherein a layer of an adhesive is formed on a side wall surface of the individual flow path; and the layer of the adhesive contains a material having a photocatalytic reaction obtaining hydrophilicity by light irradiation.

According to the above-mentioned structure, it is possible to implement stable drop jetting.

According to the above-discussed embodiment, it is possible to provide an image forming apparatus configured to form an image by jetting a liquid drop from a liquid jet head, the liquid jet head including a plurality of individual flow paths where nozzles configured to jet liquid are in communication; wherein a layer of an adhesive is formed on a side wall surface of the individual flow path; and the layer of the adhesive contains a material having a photocatalytic reaction obtaining hydrophilicity by light irradiation.

According to the above-mentioned structure, it is possible to implement stable drop jetting so that a high quality image can be formed.

According to the above-discussed embodiment, it is possible to provide a manufacturing method of a liquid jet head, the liquid jet head including a plurality of individual flow paths where nozzles configured to jet liquid are in communication; wherein a layer of an adhesive is formed on a side wall surface of the individual flow path; and the layer of the adhesive contains a material having a photocatalytic reaction obtaining hydrophilicity by light irradiation, the manufacturing method including a step of applying the material having the photocatalytic reaction to a plurality of members forming a fluid path member forming the individual member by a spray method so that the plural members are connected to each other.

According to the above-mentioned structure, it is possible to manufacture the liquid jet head of this disclosure with a simple process.

Although this disclosure has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

While the liquid jet device of this disclosure is applied to the image forming apparatus having a printer structure in the embodiments, this disclosure is not limited to this. For example, this disclosure can be applied to an image forming apparatus such as a printer, facsimile, copier, plotter, or a multiple function processing machine of the printer, facsimile, copier, and the plotter. In addition, this disclosure can be applied to an image forming apparatus and a liquid jet device using liquid other than the recording liquid.

This patent application is based on Japanese Priority Patent Application No. 2006-237507 filed on Sep. 1, 2006, the entire contents of which are hereby incorporated by reference.

What is claimed is:

1. A liquid jet head, comprising:

a plurality of individual flow paths where nozzles configured to jet liquid are in communication;

wherein a layer of an adhesive is formed on a side wall surface of the individual flow path; and the layer of the adhesive contains a material capable of having a photocatalytic reaction obtaining hydrophilicity by light irradiation; and wherein a flow path member forming the individual flow path is made by connecting plural members to each other by the adhesive.

2. The liquid jet head as claimed in claim 1, wherein a smooth convex and concave configuration is formed on the surface having the photocatalytic reaction, the surface being the side wall surface of the individual flow path.

3. The liquid jet head as claimed in claim 1, wherein the surface having the photocatalytic reaction, the surface being the side wall surface of the individual flow path, is made rough.

4. A liquid jet head, comprising:

a plurality of individual flow paths where nozzles configured to jet liquid are in communication;

wherein a layer of an adhesive is formed on a side wall surface of the individual flow path; and a layer containing a material capable of having a photocatalytic reaction obtaining hydrophilicity by light irradiation is formed on the layer of the adhesive.

5. An image forming apparatus configured to form an image by jetting a liquid drop from a liquid jet head, the liquid jet head comprising:

a plurality of individual flow paths where nozzles configured to jet liquid are in communication;

wherein a layer of an adhesive is formed on a side wall surface of the individual flow path; and the layer of adhesive contains a material having a photocatalytic reaction obtaining hydrophilicity by light irradiation; and wherein a flow path member forming the individual flow path is made by connecting plural members to each other by the adhesive.

* * * * *